US009408473B2

(12) United States Patent
Sabina

(10) Patent No.: US 9,408,473 B2
(45) Date of Patent: Aug. 9, 2016

(54) PORTABLE SUN SHADED FOLDING CHAIR

(71) Applicant: Joseph Michael Sabina, Laguna Niguel, CA (US)

(72) Inventor: Joseph Michael Sabina, Laguna Niguel, CA (US)

( * ) Notice: Subject to any disclaimer, the term of this patent is extended or adjusted under 35 U.S.C. 154(b) by 171 days.

(21) Appl. No.: 13/968,207

(22) Filed: Aug. 15, 2013

(65) Prior Publication Data

US 2015/0048657 A1 Feb. 19, 2015

(51) Int. Cl.
*A47C 7/66* (2006.01)

(52) U.S. Cl.
CPC ..... *A47C 7/66* (2013.01)

(58) Field of Classification Search
CPC ..... A47C 4/283
USPC ..... 297/45, 17, 184.11, 184.15, 184.1
See application file for complete search history.

(56) References Cited

U.S. PATENT DOCUMENTS

| | | | | |
|---|---|---|---|---|
| 1,696,362 | A | 12/1928 | Sewell | |
| 1,915,504 | A * | 6/1933 | Steen | 160/351 |
| 4,671,566 | A | 6/1987 | Knapp | |
| 4,673,211 | A | 6/1987 | Hoffman | |
| 5,205,610 | A | 4/1993 | Reninger | |
| 5,499,857 | A | 3/1996 | Lynch, Jr. | |
| 5,695,100 | A * | 12/1997 | O'Brien | 224/160 |
| 5,718,473 | A | 2/1998 | Lynch, Jr. | |
| 6,164,726 | A | 12/2000 | Reeves et al. | |
| 6,237,993 | B1 | 5/2001 | Zheng | |
| 6,247,748 | B1 * | 6/2001 | Zheng | 297/16.2 |
| 6,302,479 | B1 | 10/2001 | Zheng | |
| 6,341,822 | B2 | 1/2002 | Apissomian | |
| 6,817,671 | B1 * | 11/2004 | Zheng | 297/411.39 |
| 7,240,961 | B2 | 7/2007 | Grace | |
| 7,431,389 | B2 * | 10/2008 | Reeb et al. | 297/184.15 |
| 7,802,844 | B1 * | 9/2010 | Vencill | 297/184.14 |
| 8,205,934 | B2 | 6/2012 | Homans | |
| 2010/0102600 | A1 * | 4/2010 | Lovley, II | 297/184.15 |

FOREIGN PATENT DOCUMENTS

| | | | |
|---|---|---|---|
| CN | 2557017 | Y | 6/2003 |

* cited by examiner

*Primary Examiner* — David R Dunn
*Assistant Examiner* — Jody Giacoman
(74) *Attorney, Agent, or Firm* — Patent Law & Venture Group

(57) ABSTRACT

A folding lounge chair for resting on a ground surface has an arrangement of struts mutually hinged so that the struts are able to be bundled in a common parallel pack for compact storage and for carrying about. When unfolded, the user sits on a cloth such as a towel which is supported at the top of upright struts at one end of the cloth and by the ground surface and by further struts in contact with the ground. A sun shade is mounted on the upright struts in a position for shading the user, and may be folded out of the way when not wanted.

3 Claims, 11 Drawing Sheets

PORTABLE SUN SHADED FOLDING CHAIR

BACKGROUND

The industrial field of this disclosure relates to chairs of the type for relaxation and especially out of doors such as on the beach or in a part setting. This disclosure particularly is directed to a sling type chair and importantly, a chair that is easily folded into a compact bundle for ease in moving the chair and convenience in storage. Sling chairs are known in the prior art, but a sling chair that uses the ground service for user support and that is able to be folded into a compact mutually parallel arrangement of struts and also unfolded quickly for use is not known. Also, such a sling chair that provides a retractable and vertically positionable sun shade is not known.

BRIEF DESCRIPTION OF THE DRAWINGS

FIG. 8 is an example perspective view thereof showing the frame engaged with a sun shade, the shade in a non-shading position;

Like reference symbols in the drawing figures indicate like elements.

DETAILED DESCRIPTION

Figure 1:
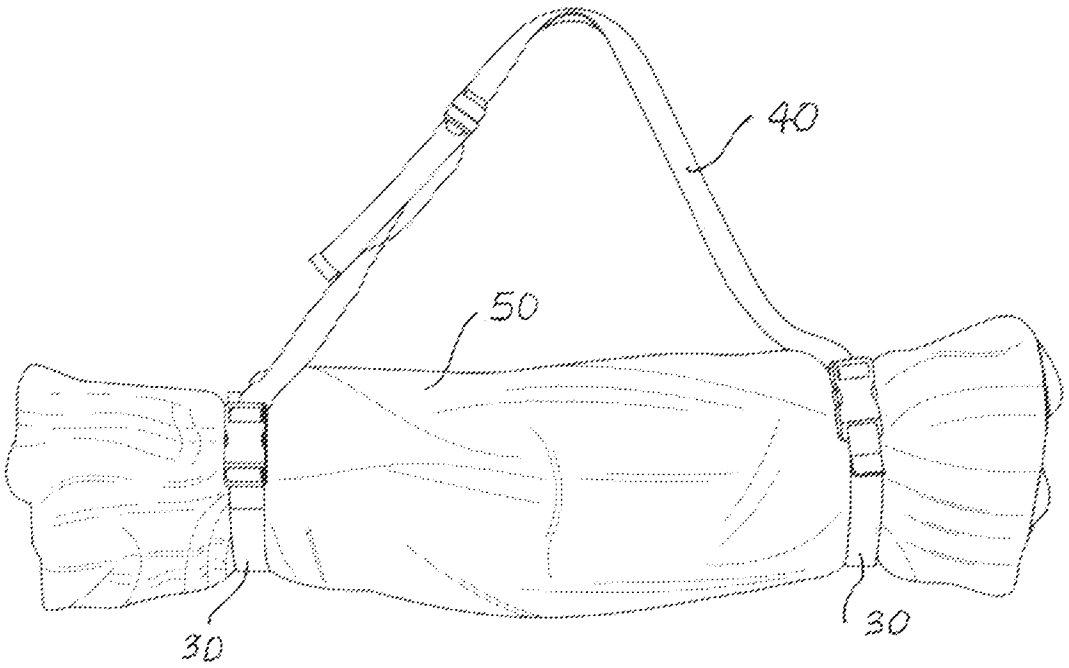
FIG. 1 is an example perspective view of the presently described apparatus as fully wrapped by a ground cloth and straps, ready for carrying.

The presently described apparatus and method of use is a folding chair 10, an apparatus for resting on a ground surface 20. As shown in FIG. 1 the chair 10 may be bundled into a compact form with bundling straps 30 and a carry strap 40. The outer wrap may be a beach towel or other sizable cloth; a ground cloth 50, which use, beside for bundling the chair 10 will be described.

Figure 2:
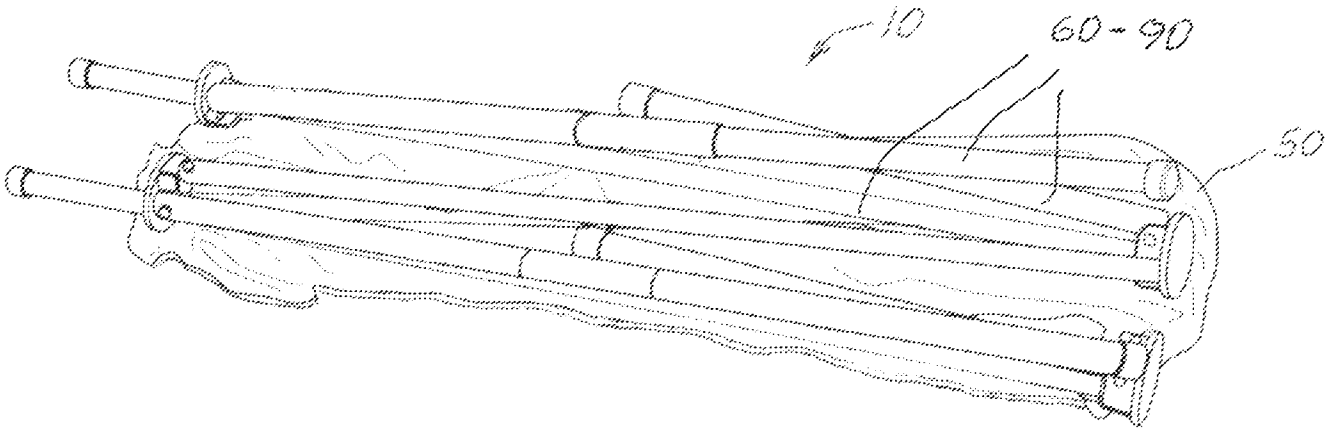
FIG. 2 is an example perspective view thereof as unwrapped.
Figure 3:
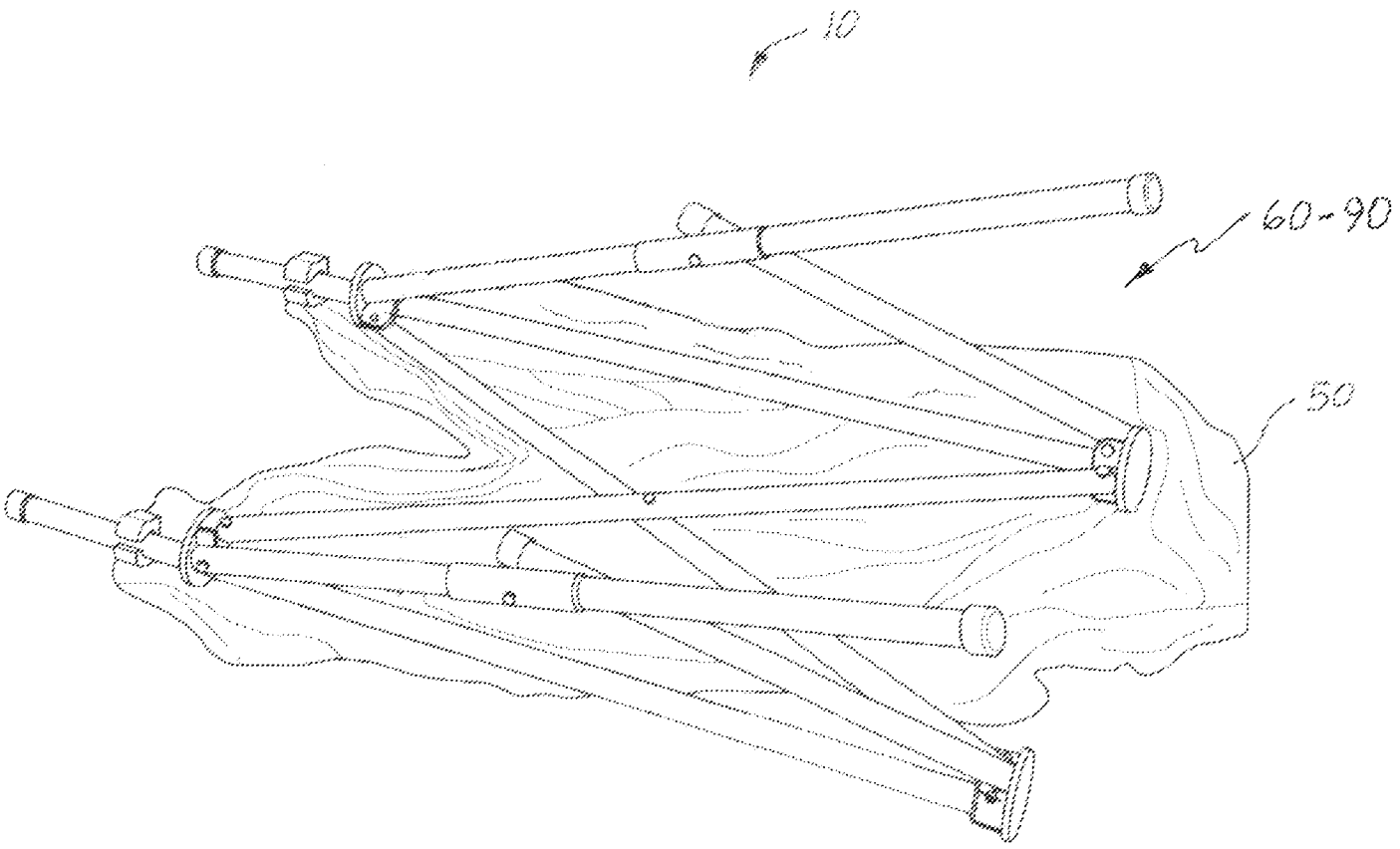
FIG. 3 is an example perspective view of a frame thereof partially unfolded.

When unwrapped, the chair 10 is, as shown in FIG. 2, a number of inter-joined folded-together struts made of a structural material such as metal or plastic. This folded arrangement wherein the struts are in close mutual proximity and in mutual parallel alignment provides for easy carrying and convenient storage. FIG. 3 shows the bundle of struts partly separated and as laid on the outer wrap; cloth 50.

Figure 4:
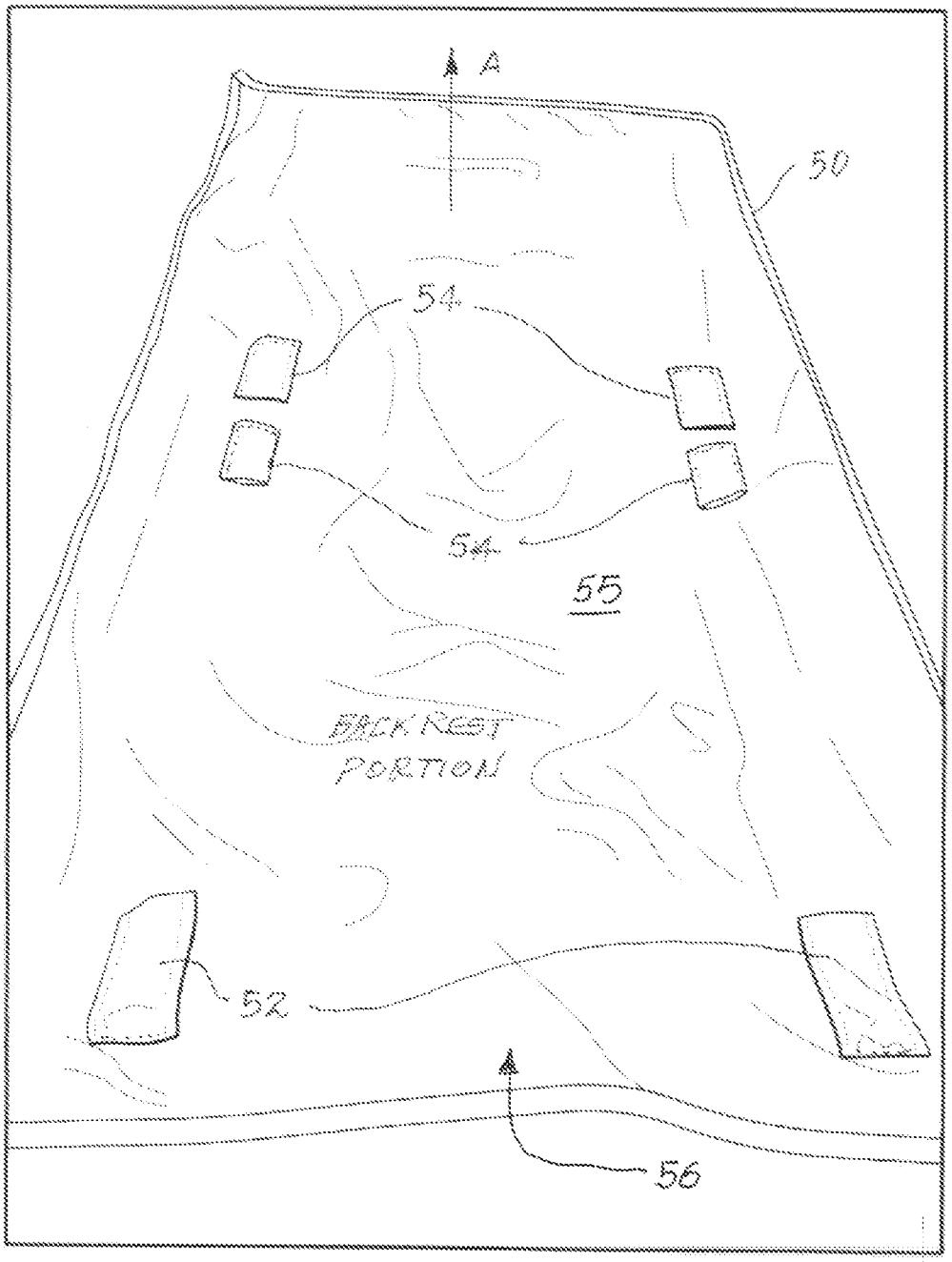
FIG. 4 is an example partial perspective view of the ground cloth thereof.

FIG. 4 illustrates the underside of cloth 50 which may be rectangular in shape and which may have pocket pairs including a first pair of pockets 52, fixed, as by being sewn at one end 56 of cloth 50, and also plural second pocket pairs as shown by pockets 54 engaged with cloth 50 in the same manner at medial positions of cloth 50. The pockets 54 typically contact ground surface 20 when ground cloth 50 is engaged with said struts and when a user sits on a top surface of cloth 50.

Figure 5:
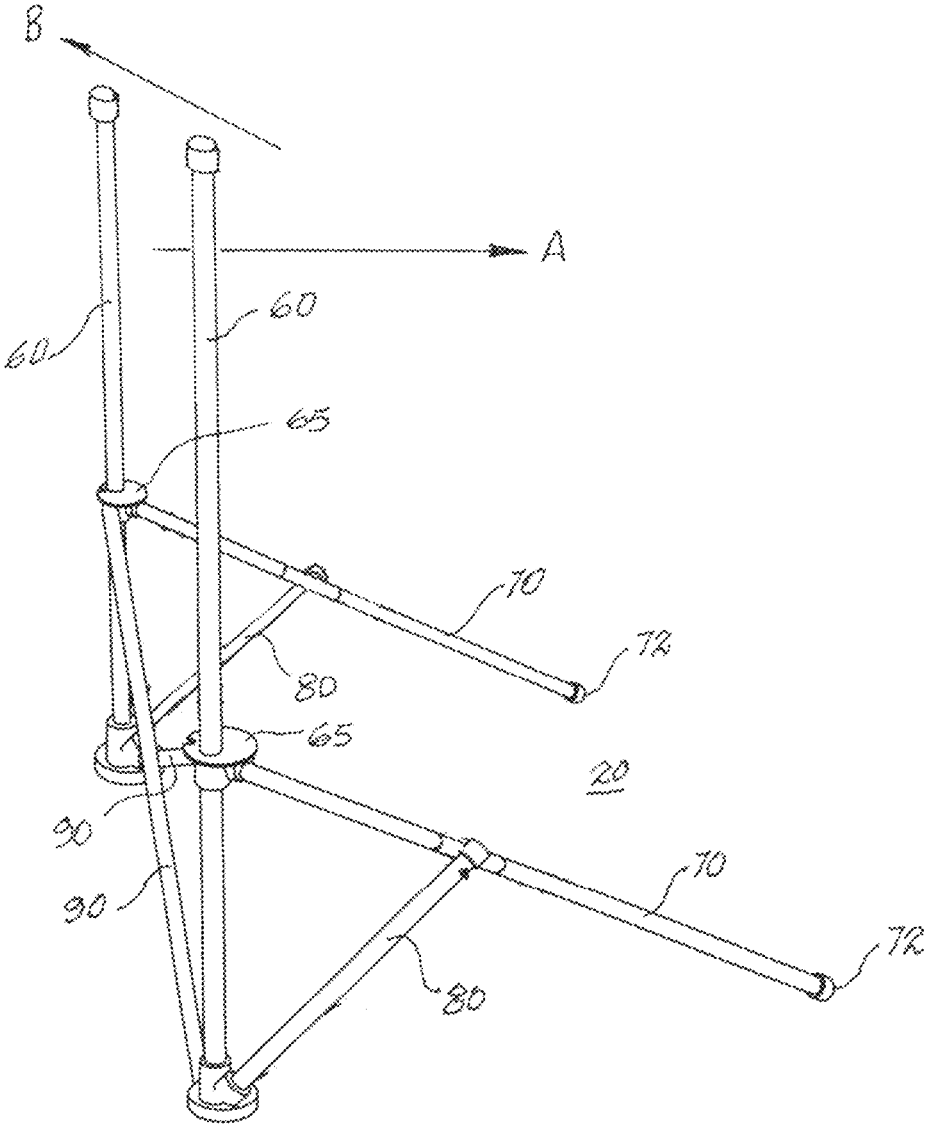
FIG. 5 is an example perspective view of the frame thereof fully unfledged and positioned for use.

As shown in FIG. 5, when the struts are fully drawn apart and positioned in their unfolded positions, said struts may include a pair of main struts 60, a pair of hinged supporting struts 70, a pair of hinged bracing struts 80, and a pair of hinged cross-linking struts 90. As shown, the struts may be arranged in the folded arrangement shown in FIG. 2 and alternately in the unfolded arrangement shown in FIG. 5 where, in the latter configuration, they form the structural portion of chair 10. FIG. 5 shows that main struts 60 are spaced apart in an upright posture with first ends resting on the ground surface 20 and having terminal upper ends. As shown, each supporting strut 70 may extend between a main strut 60 with a free end of each supporting strut 70 in contact with, the ground surface 20 in a first direction designated in FIG. 5 by arrow "A." Each bracing strut 80 may extend between a main strut 60 and a support strut 70 and in the first direction "A". Each cross-linking strut 90 may extend between the main struts 60 in a second direction shown in FIG. 5 by arrow "B." Directions "A" and "B" may be mutually orthogonal or nearly so.

Figure 6:
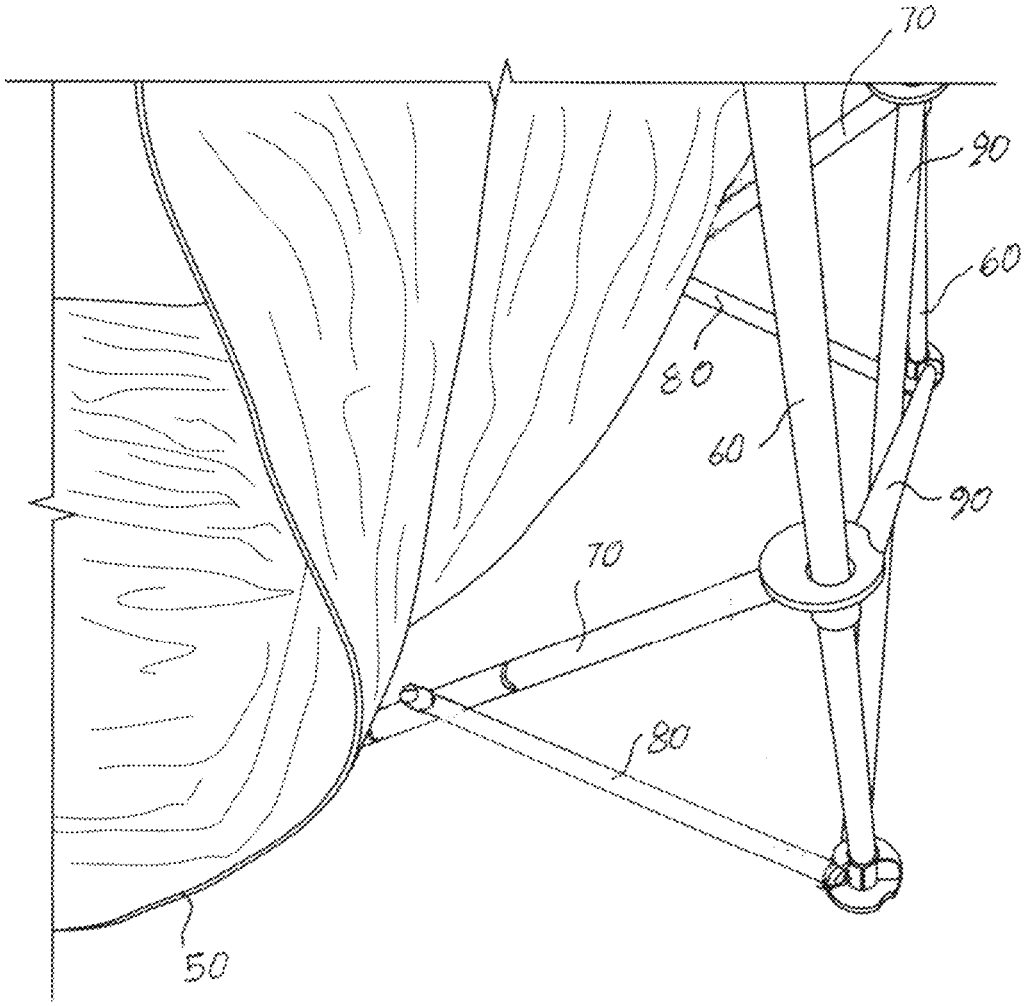
FIG. 6 is an example partial perspective view thereof showing the ground cloth draped over the frame.

The ground cloth 50 may extend between the main struts 60 and the ground surface 20 in the first direction "A" by engaging the pair of first pockets 52 with the terminal upper ends of main struts 60 and then letting cloth 50 drape down to ground surface 20 as shown in FIG. 6.

Figure 7:
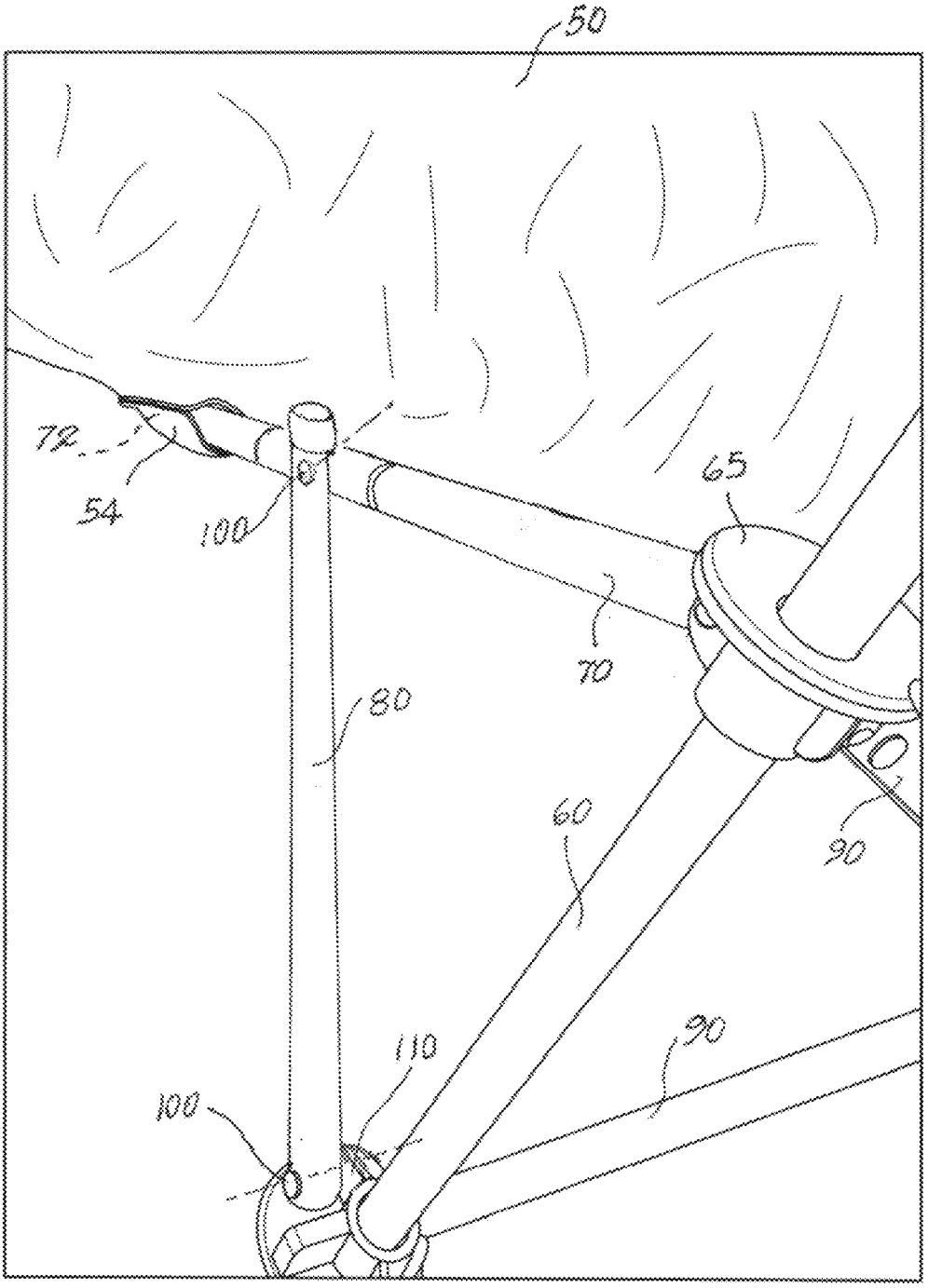
FIG. 7 is an example partial perspective view thereof showing the frame inserted into a pocket of the ground cloth.
Figure 6:
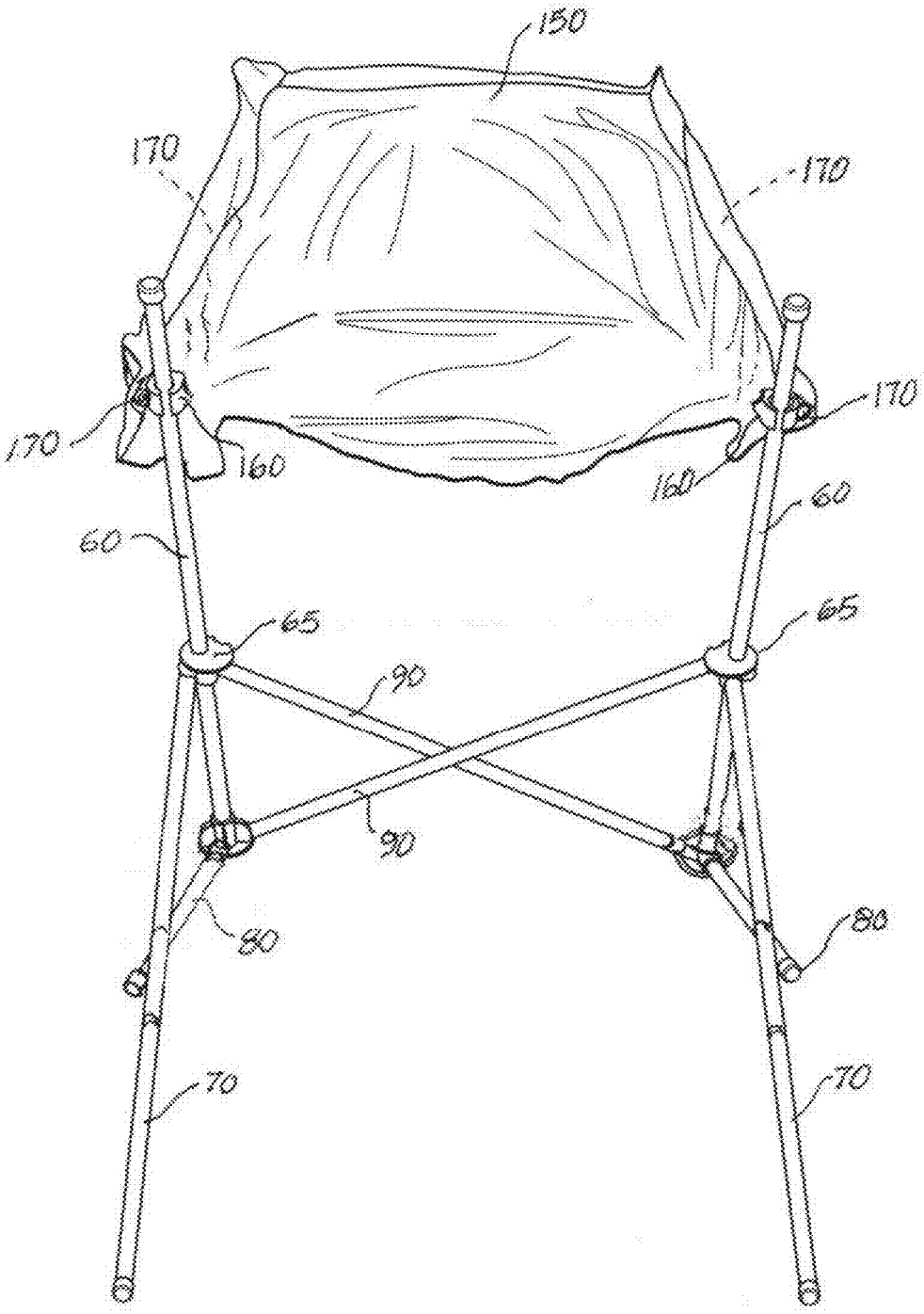

Each supporting 70, bracing 80, and cross-linking 90 strut is hinged with at least one said main strut 60, and each bracing strut 80 is also hinged with a support strut 80 as is well shown in FIG. 5 and also FIG. 8. Hinges are not shown in the drawing figures as they are well known in the art and may be of one or another alternate types including hinge pins 100 fed through the struts and also through structural webs 110 as shown in FIG. 7.

Figure 10:
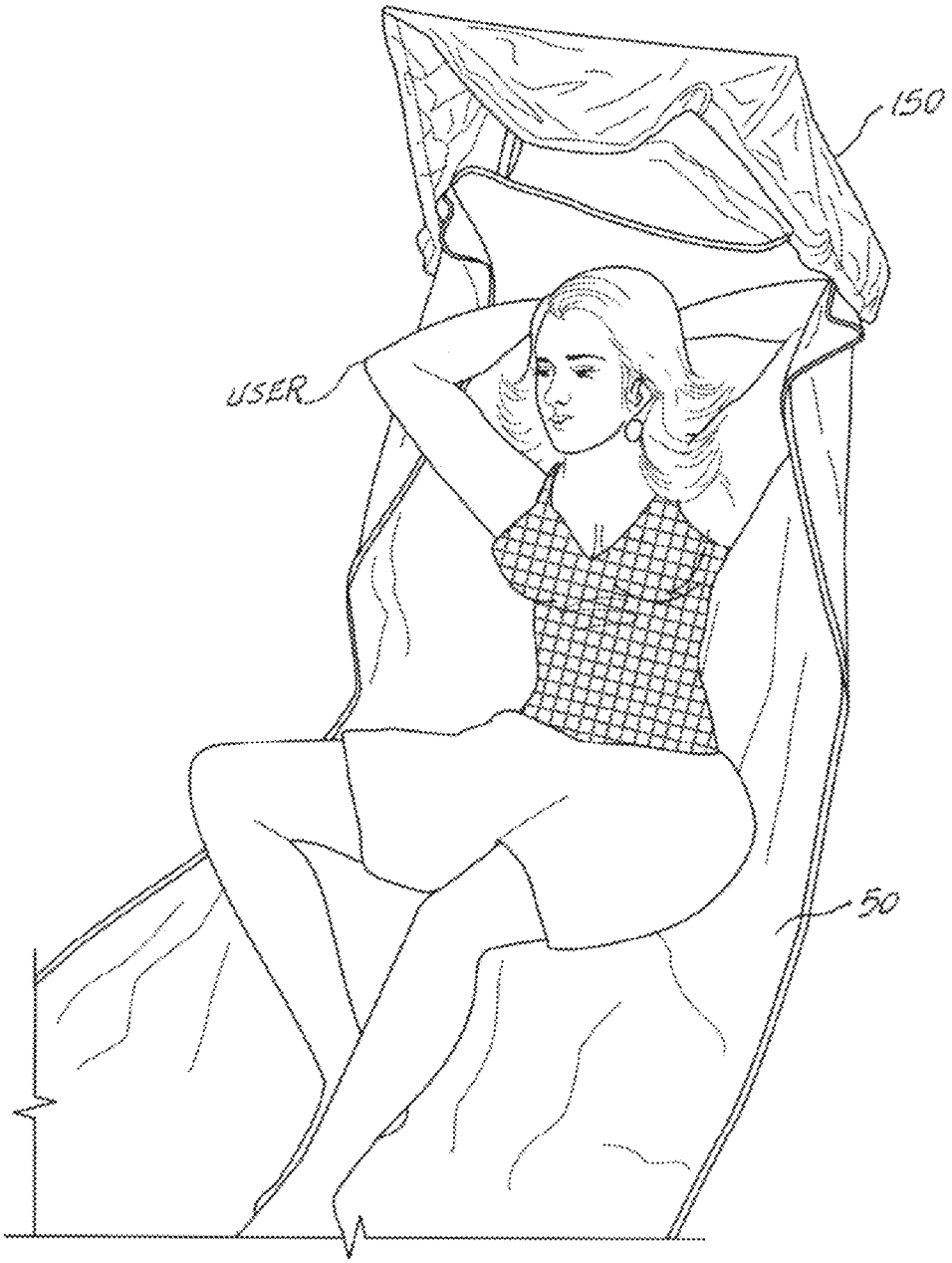
FIG. 10 is an example perspective view thereof showing the apparatus in use.

As said, plural second pairs of pocket pairs, i.e., pockets 54 are medially attached to cloth 50 and may be spaced apart in the first direction "A" as shown in FIGS. 4 and 5. As shown in FIG. 7, free ends of struts 70 may rest on ground surface 20 and may be engaged within one or another of the second pairs of pockets 54 of ground cloth 50. When cloth 50 is fixed to the tops of main struts 60 and also to the ends of support struts 70 a portion of cloth 50 is maintained above ground surface 20 and it is this portion that functions as a back rest for a user as shown in FIG. 10. It is pointed out that couplers 65 are able to slide frictionally along struts 60 and may be fixed at a desired location on struts 65 by thumb screws or any other common clamping hardware. Referring to FIG. 5 it is clearly shown that as couplers 65 are moved from the position shown in FIG. 5 to a higher position on struts 60; struts 70, 80 and 90 all move to a more vertical upright attitude and when couplers 65 are moved down, the converse occurs. When free ends 72 of struts 70 are engaged with pockets 54 which are more distant than pockets 52, couplers 65 are lowered to thereby extend ends 72 further in first direction A and this tends to raise a backrest portion of cloth 50 for the convenience of a heavier or a taller user.

Figure 9:
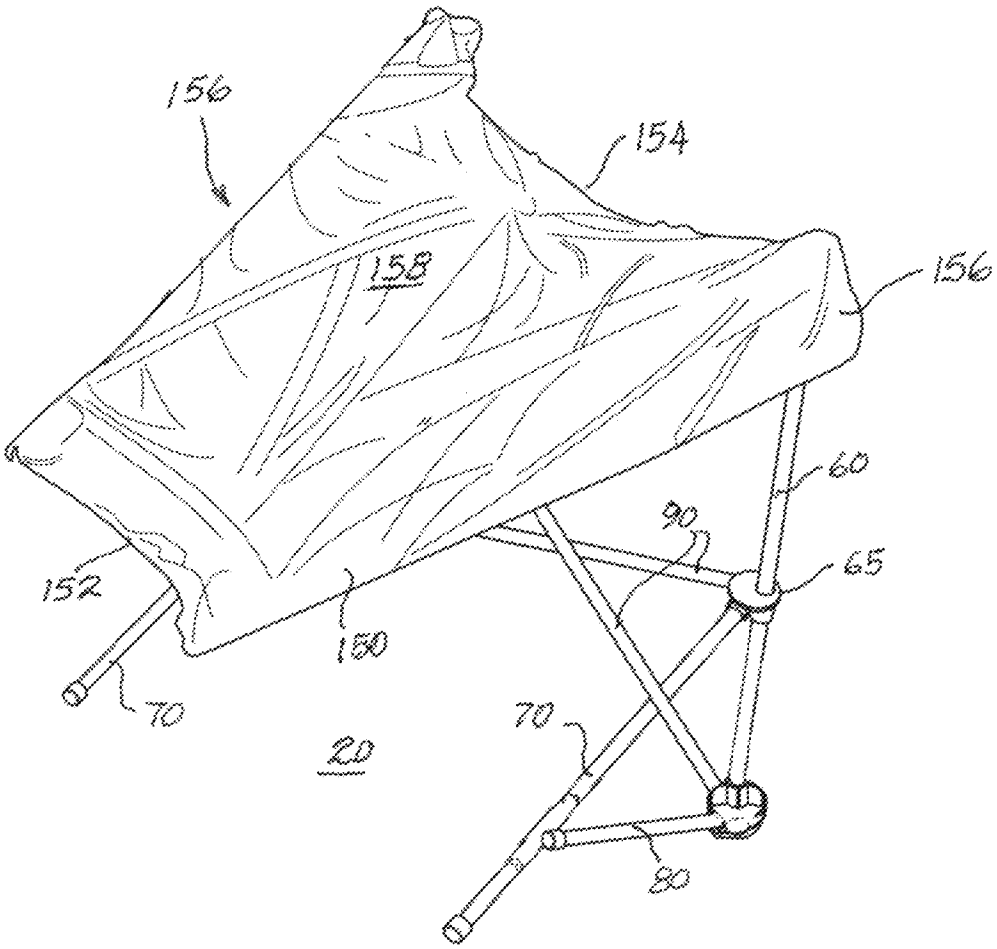
FIG. 9 is an example perspective view thereof showing the shade in a shading position.

As shown in FIGS. 8, 9, and 10, folding chair 10 may utilize a cloth sun shade 150 supported by a pair of first shade struts 170 engaged along opposing sides of shade 150 by a common attachment means. Struts 170 may be engaged in a sliding relationship with main struts 60 so shade 150 may be raised or lowered to provide for the convenience of children and adults. FIG. 8 shows that shade 150 may be folded back and out of the way when not needed as couplers 160 may readily accommodate such rotation as those of skill will find a routine matter of mechanics. In fact shade 150 may be rotated backward into a vertical position behind chair 10 for ground clearance. When in use, coupler 65 may allow shade 150 to assume the position shown in FIG. 9 where it covers cloth 50 and a user as it extends from the main struts 60 forward in first direction "A."

Figure 11:
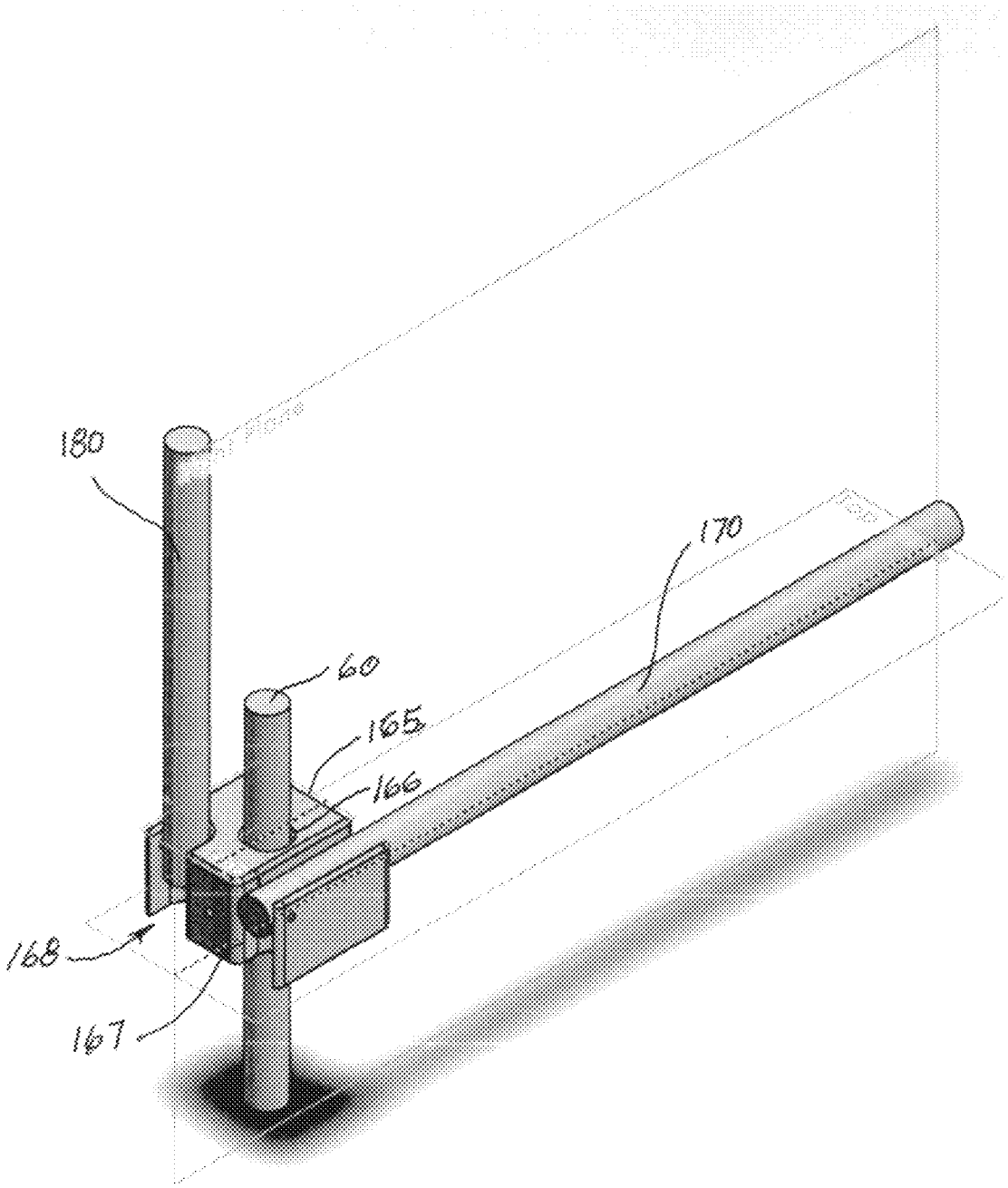
FIG. 11 is an example perspective view of an alternate embodiment of a sun shape strut coupler.

As shown in FIG. 9 it is preferred to form sun shade 150 so that it has a front transverse edge 152, a rear transverse edge 154, a pair of side panels 156, and a top panel 158, the side panels 156 being approximately triangular in shape with a diminishing height moving away from the main struts 60 in the first direction "A" assuming the position of shade 150 is as shown in FIG. 9. The triangular sides of shade 150 provide for .user protection from wind, blown sand when used on the beach, privacy and from the rays of a low sun. To accommodate the taller aspect of the rear portion of shade 150 a further embodiment of coupler 160 may be employed as shown in FIG. 11. In this embodiment coupler 165 has a central hole 166 for receiving strut 60, and a groove 167 for receiving first shade strut 170 in a pivotal relationship so that sun shade 150 may be rotated to the back area of chair 10 as previously described. A further groove 168 is provided for receiving second shade strut 180. Strut 180 is also able to rotate along with strut 170 and is long enough to support the deep end of shade 150.

Embodiments of the subject apparatus and method have been described herein. Nevertheless, it will be understood that modifications may be made without departing from the spirit and understanding of this disclosure. Accordingly, other embodiments and approaches are within the scope of the following claims.

What is claimed is:

1. A folding chair apparatus for resting on a ground surface, said folding chair apparatus comprising:

a pair of main struts having first ends for contact with said ground surface, and opposing second ends;

a pair of supporting struts extending in a first direction, each one of said pair of supporting struts having a free end for contact with the ground surface, and a further end hinged to one of said main struts;

a pair of bracing struts hinged between said main struts and said supporting struts;

a pair of cross-linking struts hinged between said main struts;

a cloth having a top surface and a bottom surface with at least three pocket pairs secured to said bottom surface;

a first pair of said pocket pairs engaged with said first ends of said main struts, said cloth draped from said first pair of said pocket pairs downwardly and in the direction of said supporting struts with a second pair of said pocket pairs engaged with said free ends of said supporting struts wherein a portion of said cloth is positioned level with said first ends of said main struts and with said free ends of said supporting struts.

2. The folding chair apparatus of claim 1 wherein at least three said pocket pairs are spaced apart for enabling said cloth to be adjustably tensioned between said main struts and said free ends of said supporting struts.

3. The folding chair apparatus of claim 1 further comprising a shade supported by a pair of spaced apart couplers, each having a pair of struts hinged thereto and separately rotatable, said couplers engaged with said main struts and vertically adjustable thereon.

* * * * *